US010464640B1

(12) United States Patent
Alrujaib

(10) Patent No.: US 10,464,640 B1
(45) Date of Patent: Nov. 5, 2019

(54) BOAT DRAIN TUBE WITH INTEGRAL LEAK DETECTOR

(71) Applicant: Bassam E. A. Alrujaib, Safat (KW)

(72) Inventor: Bassam E. A. Alrujaib, Safat (KW)

( * ) Notice: Subject to any disclaimer, the term of this patent is extended or adjusted under 35 U.S.C. 154(b) by 0 days.

(21) Appl. No.: 16/400,845

(22) Filed: May 1, 2019

Related U.S. Application Data

(60) Provisional application No. 62/683,645, filed on Jun. 12, 2018.

(51) Int. Cl.
*B63B 43/02* (2006.01)
*B63B 13/02* (2006.01)
*B63B 13/00* (2006.01)

(52) U.S. Cl.
CPC ..... *B63B 43/02* (2013.01); *B63B 13/00* (2013.01); *B63B 13/02* (2013.01); *B63B 2201/26* (2013.01)

(58) Field of Classification Search
CPC ..... B63B 13/00; B63B 13/02
USPC ..... 114/183 R, 197
See application file for complete search history.

(56) References Cited

U.S. PATENT DOCUMENTS 3,821,699 A 6/1974 Marus et al.
4,341,178 A * 7/1982 Price ..... B63B 13/00 114/183 R
4,843,376 A 6/1989 Wagner et al.
5,047,753 A 9/1991 Birchfield
5,162,793 A 11/1992 Plost et al.
5,182,556 A * 1/1993 Plost ..... B63B 13/00 114/197
6,050,867 A * 4/2000 Shields ..... B63B 13/02 114/183 R
6,615,760 B1 * 9/2003 Wise ..... B63B 13/02 114/197
7,191,722 B1 3/2007 Plost

FOREIGN PATENT DOCUMENTS

CN 2648523 Y 10/2004

* cited by examiner

*Primary Examiner* — Lars A Olson
(74) *Attorney, Agent, or Firm* — Richard C. Litman; Nath, Goldberg & Meyer

(57) ABSTRACT

The boat drain tube with an integral leak detector provides an audio and/or visual alarm to indicate the presence of a water leak within a drain of a boat. The boat drain tube includes a hollow, cylindrical tube having opposed first and second open ends, and first and second hollow, cylindrical electrodes rigidly mounted therein. The first and second hollow cylindrical electrodes are axially spaced apart from one another to define an electrically nonconductive gap therebetween. An alarm, an electrical power source, and the first and second hollow, cylindrical electrodes are connected in series to define a circuit open at the gap. The alarm may be an audio alarm, a visual alarm (such as lights, light emitting diodes or the like), or a combination of audio and visual alarms. When water enters the gap between the first and second hollow cylindrical electrodes, the circuit closes to activate the alarm.

12 Claims, 3 Drawing Sheets

BOAT DRAIN TUBE WITH INTEGRAL LEAK DETECTOR

CROSS-REFERENCE TO RELATED APPLICATION

This application claims the benefit of U.S. Provisional Patent Application No. 62/683,645, filed on Jun. 12, 2018.

BACKGROUND

1. Field

The disclosure of the present patent application relates to boating safety devices, and more particularly to a boat drain tube with integral leak detector for detecting when a boat has been launched without a plug installed in the drain tube.

2. Description of the Related Art

Small boat hulls commonly have an aft drain for draining water when the boat is in use. FIG. 2 illustrates a typical boat drain tube 100. Boat drain tube 100 includes a hollow cylindrical shell 102 which is sized to fit into drain opening D formed through the aft hull of boat B. One end of hollow cylindrical shell 102 has an annular flange 104 with openings 106 formed therethrough. Openings 106 are aligned with corresponding openings 110, formed through the aft hull about drain opening D, such that screws 108, bolts or the like may be used to secure annular flange 104 to the hull, thus securing the hollow cylindrical shell 102 within the drain opening D. As shown, an inner surface of the hollow cylindrical shell 102 has threads 116 formed thereon. This allows the hollow cylindrical shell 102 to be securely closed and sealed by a plug 112, which has mating threads 114 formed thereon.

In a common boat drain tube, such as boat drain tube 100 of FIG. 2, the hollow cylindrical shell 102 is typically formed from plastic, fiberglass or the like, and the plug 112 is typically formed from similar materials. Thus, due to time and wear, the ability of the plug 112 to completely seal the hollow cylindrical shell 102 degrades, eventually leading to leakage of water into the boat B. Such leaks are typically detected visually, i.e., the sailor of the boat B typically does not discover the leak until a visible stream of water is entering the boat B. It would obviously be of great value to be able to detect such leaks as soon as they begin so that hollow cylindrical shell 102 and/or plug 112 can be replaced before a major leak occurs. Similarly, even without considering leakage through or around the plug 112, if the boater forgets to plug or otherwise close the hollow cylindrical shell 102 before launching the boat B, water will leak into the boat B, thus creating a hazardous situation. Thus, a boat drain tube with an integral leak detector solving the aforementioned problems is desired.

SUMMARY

The boat drain tube with integral leak detector provides an audio and/or visual alarm to indicate the presence of a water leak through the drain of a boat. The boat drain tube with integral leak detector includes a hollow cylindrical tube having opposed first and second open ends, and first and second hollow, cylindrical electrodes mounted therein. The first and second hollow, cylindrical electrodes are axially spaced apart from one another to define a gap therebetween. An alarm, an electrical power source, and the first and second hollow cylindrical electrodes are connected in series to define a circuit. The alarm may be an audio alarm, a visual alarm (such as lights, light emitting diodes or the like), or a combination of audio and visual alarms. The electrical power source may be a rechargeable battery or the like.

Each of the first and second hollow cylindrical electrodes may be threaded for releasable mating with a threaded cylindrical plug, similar to a conventional boat plug and drain tube. The threaded cylindrical plug is inserted through the first open end of the hollow cylindrical tube and is releasably secured therein through threaded engagement with the first and second hollow cylindrical electrodes. If the threaded cylindrical plug does not properly seal the hollow cylindrical tube, water will leak into the interior of the hollow cylindrical tube. When the water enters the gap between the first and second hollow cylindrical electrodes, the circuit closes to activate the alarm. Additionally, even without considering leakage through or around the threaded cylindrical plug, if the boater forgets to plug or otherwise close the hollow, cylindrical shell before launching the boat, water will leak into the boat through the hollow, cylindrical shell, thus closing the circuit and activating the alarm, indicating to the boater that he/she has forgotten to plug or otherwise seal the hollow cylindrical tube.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
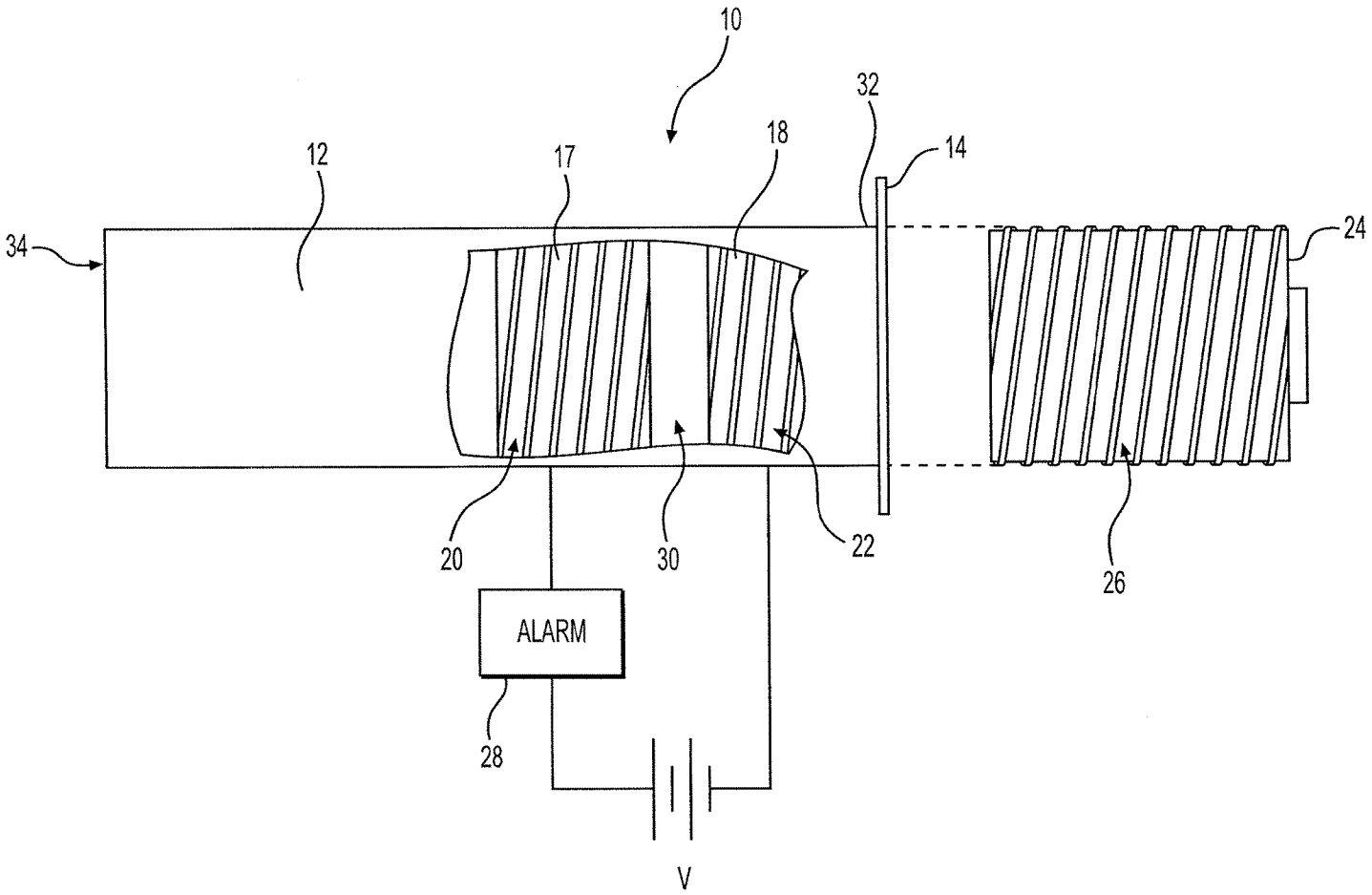
FIG. 1 is side view of a boat drain tube with an integral leak detector, the drain tube being partially broken away to show the interior of the tube.
Figure 2:
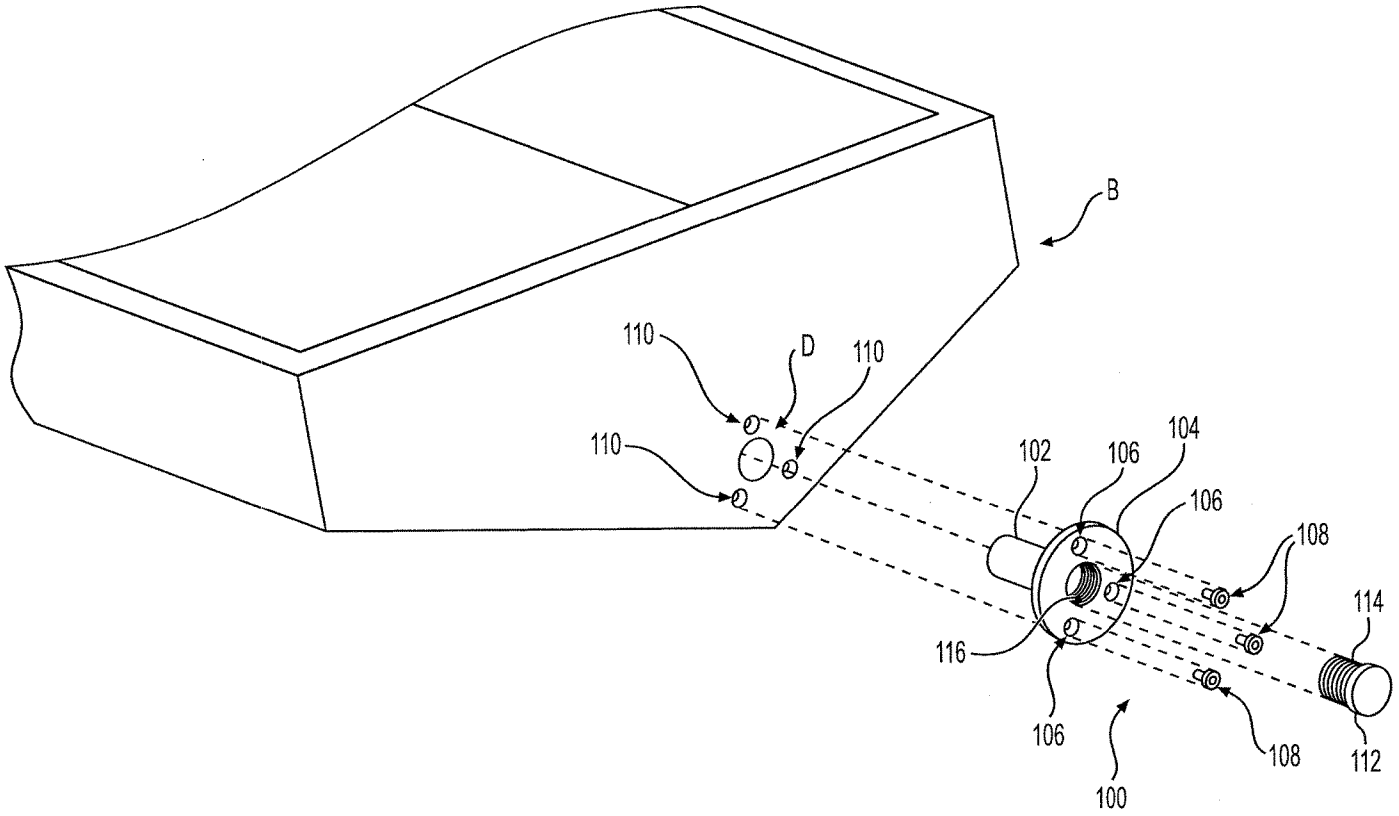
FIG. 2 (PRIOR ART)
FIG. 2 is an exploded, environmental perspective view of a boat drain tube of the prior art.
Figure 3:
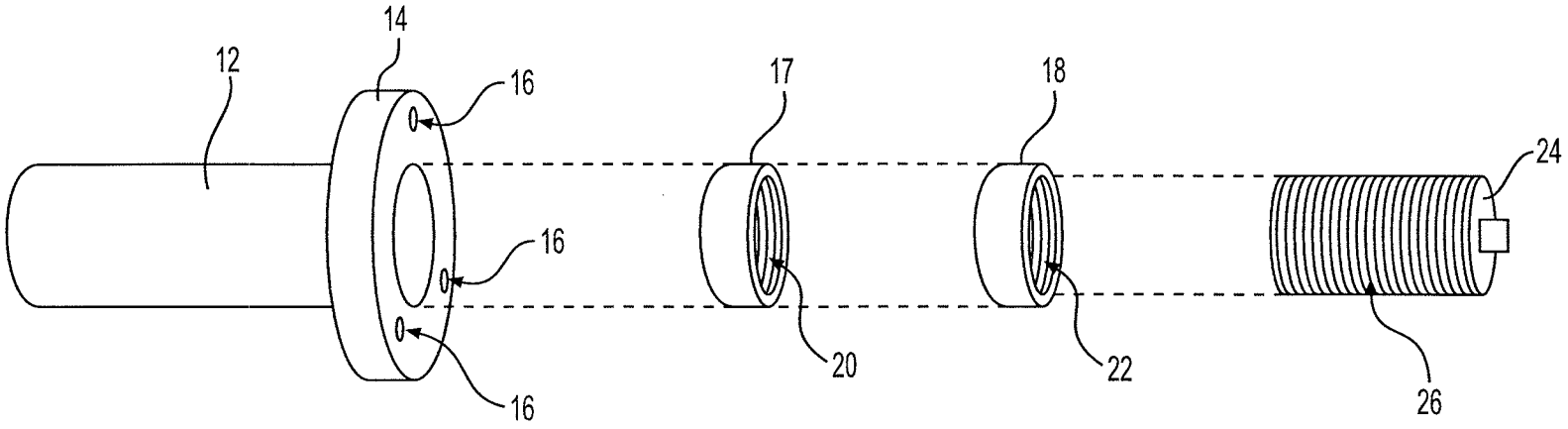
FIG. 3 is a partially exploded perspective view of the boat drain tube of FIG. 1.

The boat drain tube with an integral leak detector, designated generally as 10 in the drawings, provides an audio and/or visual alarm to indicate the presence of a water leak within a drain of a boat, such as the exemplary boat B of FIG. 2. As shown in FIGS. 1 and 3, the boat drain tube 10 includes a hollow, cylindrical tube 12, having opposed first and second open ends 32, 34, respectively, and first and second hollow, cylindrical electrodes 17, 18, respectively, rigidly mounted therein, i.e., the electrodes 17, 18 are fixed in the tube 12 and do not rotate or move translationally in the tube 12. Similar to the conventional boat drain tube 100 of FIG. 2, an annular flange 14 may extend about the first open end 32 of the hollow, cylindrical tube 12. Similarly, at least one aperture 16 may be formed through the annular flange 14 for receiving a fastener, such as exemplary screws 108 of FIG. 2. It should be understood that the overall appearance, relative dimensions, and configuration of the hollow, cylindrical tube 12 and the annular flange 14 are shown for exemplary purposes only. Similarly, it should be understood that the three apertures 16 shown formed through the annular flange 14 in FIG. 3 are shown for exemplary purposes only, and that any suitable number of apertures 16 may be formed through the annular flange 14. Further, it should be understood that the overall appearance, relative dimensions, and configuration of the first and second hollow, cylindrical electrodes 17, 18 are shown for exemplary purposes only, and may be vary depending upon the overall configuration of the hollow, cylindrical tube 12.

The first and second hollow, cylindrical electrodes 17, 18 are axially spaced apart from one another to define an air gap 30 therebetween, the gap 30 being both a physical separation and an electrically nonconductive separation when the inside of the tube 12 is dry. An alarm 28, an electrical power source V, and the first and second hollow, cylindrical electrodes 17, 18 are connected in series to define a circuit, except for the open defined by the gap 30. The alarm 28 may be an audio alarm, a visual alarm (such as lights, light emitting diodes or the like), or a combination of audio and visual alarms. The electrical power source V may be a rechargeable battery or the like. The alarm circuit may also include a manually operated on/off power switch so that power to the alarm circuit may be manually shut off when it is desired to drain water out of the boat B using the boat drain D.

As shown, each of the first and second hollow, cylindrical electrodes 17, 18 may be internally threaded for releasable mating with a cylindrical plug 24 having an externally threaded surface 26, similar to the conventional boat plug and drain tube shown in FIG. 2. Internal threads 20, 22 of the first and second hollow, cylindrical electrodes 17, 18, respectively, are best seen in the cut-away portion of FIG. 1. The externally threaded cylindrical plug 24 is inserted through the first open end 32 of the hollow, cylindrical tube 12 and is releasably secured therein through threaded engagement with the first and second hollow cylindrical electrodes 17, 18. If the threaded cylindrical plug 24 does not properly seal the hollow cylindrical tube 12, water will leak into the interior of hollow, cylindrical tube 12. When the water enters the gap 30 between the first and second hollow, cylindrical electrodes 17, 18, the circuit is shorted and closes to activate the alarm 28, indicating to the boater that there is a water leak. Additionally, even without considering leakage through or around the threaded cylindrical plug 24, if the boater forgets to plug or otherwise close the hollow, cylindrical shell 12 launching the boat B, water will leak into the boat B through the hollow, cylindrical shell 12, thus closing the circuit and activating the alarm 28, indicating to the boater that he/she has forgotten to plug or otherwise seal the hollow, cylindrical tube 12.

It should be understood that first and second hollow, cylindrical electrodes 17, 18 may be formed from any suitable type of electrically conductive material, such as copper or the like. It should also be understood that the hollow, cylindrical tube 12 and the cylindrical plug 24 may be formed from any suitable type of electrically insulating and waterproof material, such as fiberglass, plastic or the like, so that the plug 24 does not short the electrodes 17, 18 when threaded into the electrodes.

It will be obvious to those of ordinary skill in the art that various improvements may be made in the electrical circuit, such as using the shorting current between the electrodes 17, 18 to turn on a low voltage or current relay to close the contacts on a higher voltage or current switch in the alarm circuit. The present boat drain tube with an integral leak detector 10 works best when the boat is used in a saltwater body of water so that the salt provides and electrolyte to carry a higher current across the gap 30 between the electrodes 17, 18.

It is to be understood that the boat drain tube with an integral leak detector is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A boat drain tube with an integral leak detector, comprising:

a hollow, cylindrical tube having opposed first and second open ends, the tube being dimensioned and configured for mounting in a boat drain, the boat drain being selectively closed when a mating plug is removably installed in the tube;

first and second hollow, cylindrical electrodes rigidly mounted within the hollow, cylindrical tube, the first and second electrodes being axially spaced apart from one another to define an electrically nonconductive gap therebetween, wherein each of the first and second hollow, cylindrical electrodes is internally threaded for releasable mating with an externally threaded mating plug;

an alarm; and an electrical power source, the alarm, the electrical power source, and the first and second hollow cylindrical electrodes being electrically connected in series to define a circuit opened by the gap between the electrodes, so that when water from a leak through the boat drain enters the gap between the first and second hollow cylindrical electrodes, the electrodes are shorted together, closing the circuit and activating the alarm.

2. The boat drain tube as recited in claim 1, wherein said hollow, cylindrical tube comprises an annular mounting flange extending about the first open end thereof.

3. The boat drain tube as recited in claim 2, wherein said mounting flange has at least one aperture defined therein for receiving a fastener.

4. The boat drain tube as recited in claim 1, wherein the alarm comprises at least one alarm selected from the group consisting of an audio alarm and a visual alarm.

5. The boat drain tube with an integral leak detector as recited in claim 1, wherein the electrical power source comprises a rechargeable battery.

6. A boat plug and drain tube with an integral leak detector, comprising:

an externally threaded cylindrical plug;

a hollow, cylindrical tube having opposed first and second open ends, the tube being dimensioned and configured for mounting in a boat drain, the boat drain being selectively closed when the cylindrical plug is removably installed in the tube;

first and second hollow, cylindrical electrodes rigidly mounted within the hollow, cylindrical tube, the first and second hollow, cylindrical electrodes being axially spaced apart from one another to define an electrically nonconductive gap therebetween, the cylindrical plug being at least partially removably received within the first and second hollow cylindrical electrodes to selectively close the boat drain, wherein each of the first and second hollow cylindrical electrodes is internally threaded for releasable mating with the externally threaded cylindrical plug;

an alarm; and an electrical power source, the alarm, the electrical power source, and the first and second hollow cylindrical electrodes being connected in series to define a circuit open at the gap between the first and second electrodes, the electrodes shorting together to close the circuit when water enters the gap between the first and second hollow, cylindrical electrodes, thereby activating the alarm.

7. The boat plug and drain tube as recited in claim 6, wherein said hollow, cylindrical tube comprises an annular mounting flange extending about the first open end thereof.

8. The boat plug and drain tube as recited in claim 7, wherein said mounting flange has at least one aperture defined therein for receiving a fastener.

9. The boat plug and drain tube as recited in claim 6, wherein the alarm comprises at least one alarm selected from the group consisting of an audio alarm and a visual alarm.

10. The boat plug and drain tube as recited in claim 6, wherein the electrical power source comprises a rechargeable battery.

11. The boat plug and drain tube according to claim 6, wherein said cylindrical plug is made from electrically nonconductive material.

12. A boat, comprising:

a bow and a stern, the stern having a drain passage defined therein;

a drain tube extending through the drain passage, the drain tube being sealed against the stern to form a waterproof drain;

a positive electrode and a negative electrode, the electrodes at least partially lining the drain tube and being axially separated from each other by an air gap therebetween, wherein each of the positive and negative electrodes are tubular and internally threaded;

an alarm circuit having a first end connected to the positive electrode and a second end connected to the negative electrode; and a drain plug selectively and removably stopping the drain tube to prevent passage of water through the boat drain, the drain plug being electrically nonconductive, wherein the drain plug is externally threaded for releasable mating with the internally threaded tubular electrodes;

wherein passage of water through the air gap between the electrodes closes the alarm circuit to activate an alarm signaling undesired passage of water through the boat drain.

* * * * *